US006142390A

United States Patent [19]

Nordstrom et al.

[11] Patent Number: 6,142,390

[45] Date of Patent: Nov. 7, 2000

[54] NOZZLE ASSEMBLY FOR A SPRAY HEAD

[75] Inventors: Lindsay Erik Nordstrom, Glenorie; Philip Clayton Nordstrom, Katoomba, both of Australia

[73] Assignee: Exell Trading PTY Limited, Glenorie, Australia

[21] Appl. No.: 09/214,442

[22] PCT Filed: Jul. 3, 1997

[86] PCT No.: PCT/AU97/00420

§ 371 Date: Jun. 9, 1999

§ 102(e) Date: Jun. 9, 1999

[87] PCT Pub. No.: WO98/01229

PCT Pub. Date: Jan. 15, 1998

[30] Foreign Application Priority Data

Jul. 3, 1996 [AU] Australia ..... PO 0804

[51] Int. Cl.[7] ..... B05B 1/34

[52] U.S. Cl. ..... 239/490; 239/451; 239/456; 239/494; 239/497; 285/298

[58] Field of Search ..... 239/390, 391, 239/396, 490, 494, 497, 463, 468, 548, 555, 556, 565, 590.5, 456, 451; 285/298, 302

[56] References Cited

U.S. PATENT DOCUMENTS

| | | | |
|---|---|---|---|
| 1,033,603 | 7/1912 | Manly | 239/490 |
| 2,511,380 | 6/1950 | Stadler | 239/490 |
| 3,526,367 | 9/1970 | Trihey | 239/556 |
| 5,044,560 | 9/1991 | Cheng | 239/490 X |

*Primary Examiner*—Andres Kashnikow
*Assistant Examiner*—Robin O. Evans
*Attorney, Agent, or Firm*—Abelman, Frayne & Schwab

[57] ABSTRACT

A nozzle assembly for a spray head (10) having a tubular body (11) that has an inlet (13) thereto and an outlet (14) therefrom, has a nozzle member (15) and a core member (16). The nozzle member (15) has a central chamber (20) adapted to be in fluid communication with the inlet (13) of the spray head (10) and a plurality of outer chambers (22) in communication with the central chamber (20) and adapted to be in fluid communication with the outlet (14) of the spray head (10). The nozzle member (15) and/or the core member (16) has means for spacing the core member with respect to the nozzle member (15).

11 Claims, 4 Drawing Sheets

NOZZLE ASSEMBLY FOR A SPRAY HEAD

TECHNICAL FIELD

The present invention relates to a nozzle assembly for spray heads which may be used for various spraying applications.

BACKGROUND ART

There are many known types of spray heads which can be used for various spraying applications. Different types of nozzles provide a different type of spray emanating therefrom. Most nozzles provide a spray having the shape of a cone whereby the water or liquid being sprayed forms the outside surface of the cone only. Some nozzles are adjustable to provide for finer or coarse droplets of spray as required.

Even though such described nozzles are used widely, one major disadvantage is that the spray only forms the outside periphery of a cone. Therefore when spraying the water or liquid, a centre target area is left almost dry which is commonly known as a hollow cone.

One known type of spray head as described in EPA353984 by Yap Yoen Cheng, provides a spray which has an even distribution of droplets throughout the middle of the cone. This particular nozzle of this spray head uses an outer disc having a plurality of nozzle chambers in order to produce the even type spray, Disadvantages of this prior art spray head are that it is complicated to manufacture, difficult to adjust the cone angle of the spray without wetting the fingers and the nozzle disc must be rotated numerous times to effect adjustment of the spray cone angle. Moreover, the helical movement along the vortex of the internal chamber cannot be pre-determined with accuracy in relation to pressure and spray angle. Furthermore, the spray head gradually works off its desired optimum spray angle due to the amount of pressure applied to the central chamber.

SUMMARY OF THE INVENTION

It is an object of the present invention to provide an improved spray head which substantially overcomes or ameliorates the abovementioned disadvantages.

According to one aspect of the present invention there is provided a nozzle assembly for a spray head having a tubular body or housing that has an inlet thereto and an outlet therefrom, said nozzle assembly comprising a nozzle member and a core member, said nozzle member having a central chamber adapted to be in fluid communication with the inlet of the spray head and a plurality of outer chambers in communication with the central chamber and adapted to be in fluid communication with the outlet of the spray head, said nozzle member and/or said core member having means for spacing the core member with respect to the nozzle member.

Preferably, the core member is removable and replaceable so that the height of the central chamber may be varied by using different core members.

BRIEF DESCRIPTION OF THE DRAWINGS

In order that the invention may be more readily understood and put into practical effect, reference will now be made to the accompanying drawings in which.

MODES FOR CARRYING OUT THE INVENTION

Figure 1:
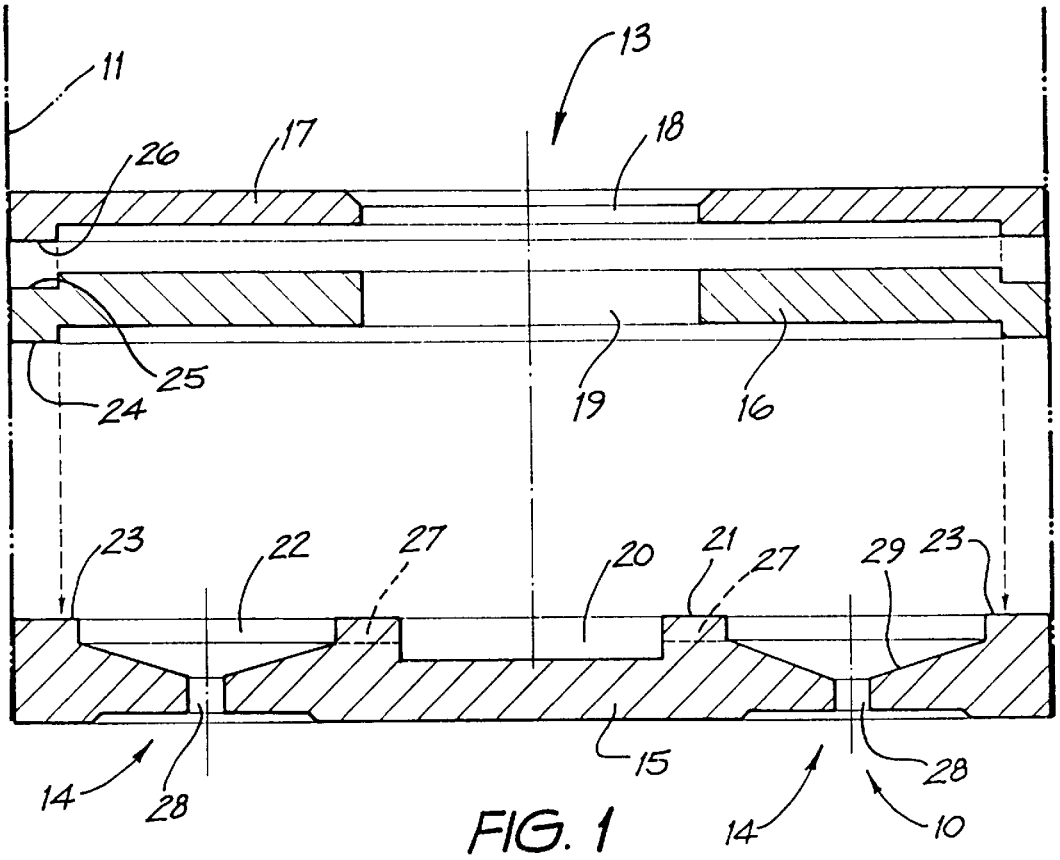
FIG. 1 is an exploded side view of a spray head incorporating a nozzle according to a first embodiment of the invention.

The spray head shown in FIG. 1 includes a tubular body or housing 11 of any convenient type or configuration which has an inlet 13 thereto and a plurality of outlets 14 therefrom. The housing 11 contains a nozzle member 15, a replaceable core member 16 and a washer 17. The washer 17 has a central aperture 18 and the core member 16 has a similar central aperture 19.

The nozzle member 15 has an inwardly directed central chamber 20 defined by inner annular wall 21 and a plurality of outer chambers 22 defined between the inner wall 21 and the outer wall 23. The central chamber 20 is in fluid communication with the outer chambers 22 by means of passageways 27.

The outer wall 23 provides a seat for a peripheral rim 24 on the underside of the core member 16. The height of the wall 23 and/or rim 24 dictates the height of the central chamber 20. The washer 17 has a peripheral rim 26 which seats in an annular recess 25 of the core member 16.

The height of the central chamber in combination with a set fluid pressure will create a defined spray angle and flow rate from the orifices 28 of the nozzle member 15. In the prior art, helical movement that either expands or contracts the chamber cannot remain stationary in a pre-determined position, as pressure from the fluid shifts the chamber along its helix. Pre-determined fixed settings of pressure spray angle, so that they remain constant throughout a spraying program, can only be accomplished by fixing the height of the chamber as shown in FIG. 1. The spray angle will also depend upon the shape of the orifice and the width of the orifice.

Figure 2:
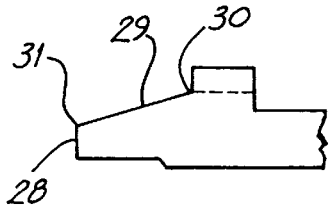
FIG. 2 is a partial side view of the nozzle of FIG. 1 showing a preferred profile of the outer chamber.

As can be seen in FIG. 1, each outer chamber 22 is defined by inner wall 21 and outer wall 23 and has a bottom face 29 which contains the orifice 28. Various configurations of the bottom face 29 is shown in FIGS. 2 to 5. In FIG. 2, the outer chamber 22 has a squared edge 30 at the exit end of the passageway 27 and a squared edge 31 at the orifice 28. In between the edges 30 and 31, the surface 29 may have a concaved, planar or convexed contour of any convenient configuration.

Figure 3:
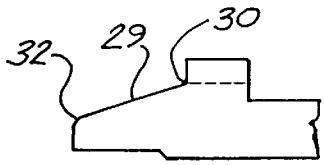
FIG. 3 is a partial side view of the nozzle of FIG. 1 showing a second preferred profile of the outer chamber.
Figure 4:
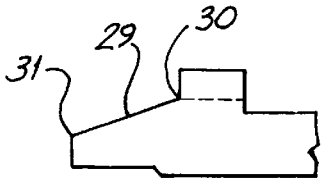
FIG. 4 is a partial side view of the nozzle of FIG. 1 showing a third preferred profile of the outer chamber.

In FIG. 3, the squared edge 31 is replaced by a rounded edge 32. In FIG. 4, the face 29 is inclined at an angle to the squared edge 31 with several different representations of the surface 29 being shown. The angle of the surface 29 to a horizontal passing through the squared edge 31 may be from 5° to 45°.

Figure 5:
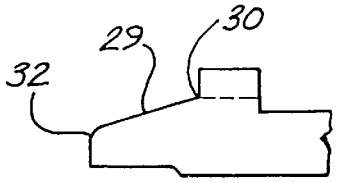
FIG. 5 is a partial side view of the nozzle of FIG. 1 showing a fourth preferred profile of the outer chamber.

In FIG. 5, the squared edge 31 of FIG. 4 is replaced by the curved edge 32 of FIG. 3 with the surface 29 of FIG. 5 being similar to that of FIG. 4.

The orifice 28 may be of constant cross section as shown in FIG. 1 and the thickness of the nozzle member 15 may be varied to increase or decrease the length of the nozzle 28. The nozzle 28 may, of course, be of any convenient shape such as outwardly diverging, outwardly converging or a combination of inwardly converging then outwardly converging.

Figure 6:
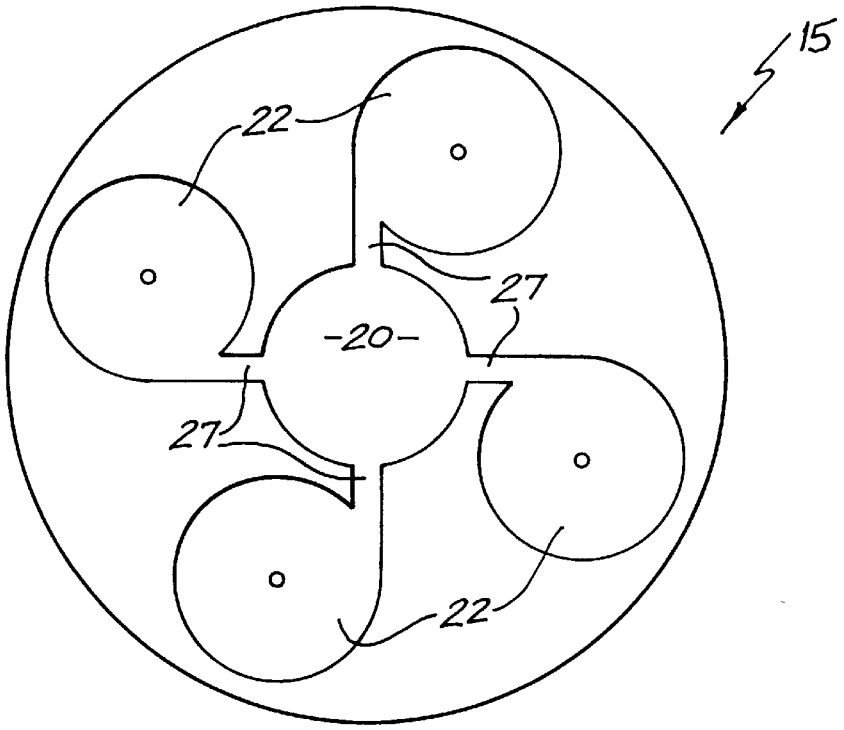
FIG. 6 is a plan view of a nozzle member according to the first embodiment of the invention.

The nozzle member 15 shown in FIG. 6 has four outer chambers 22 connected to the central chamber 20 by the passageways 27.

Figure 7:
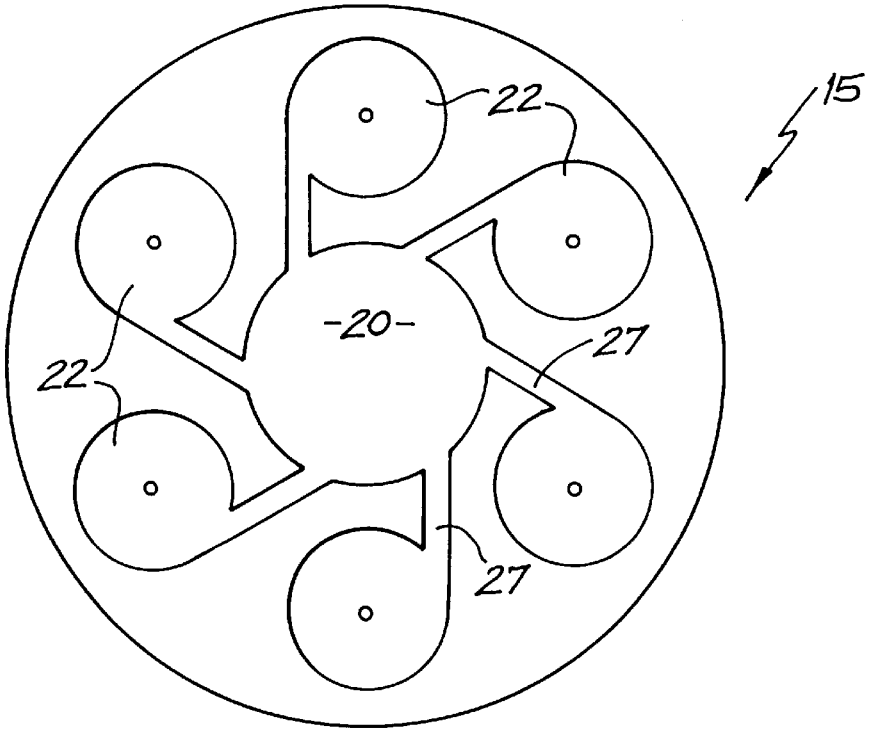
FIG. 7 is a plan view of a nozzle member according to the second embodiment of the invention.
Figure 8:
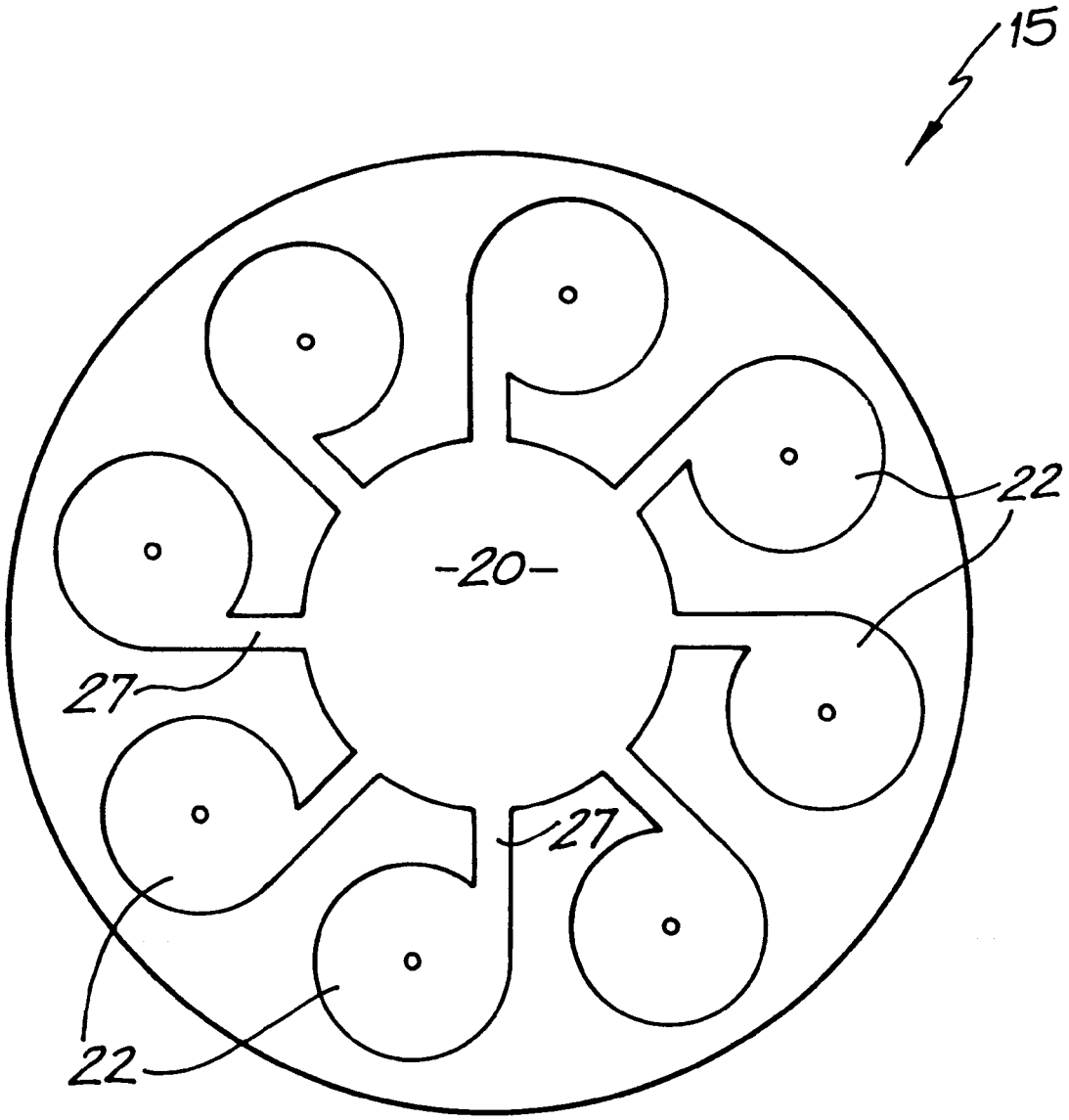
FIG. 8 is a plan view of a nozzle member according to the third embodiment of the invention.

The nozzle member 15 shown in FIG. 7 has six outer chambers 22 which are connected to an enlarged central chamber 20 by passageways 27. As the number of outer chambers increases, so must the size of the central chamber 20. Thus, in FIG. 8, the nozzle member 15 which has eight outer chambers has a larger central chamber 20 than the nozzle member 15 of FIG. 7 or FIG. 6.

The passageways 27 of the various embodiments are of appropriate length and width in order to accommodate various outer chamber configurations.

As indicated above, the nozzle member 15 may be of a suitable thickness and a convenient diameter. Presently preferred parameters of the nozzle member 15 are:

| NOZZLE DIAMETER (mm) | CENTRAL CHAMBER DIAMETER (mm) | ORIFICE DIAMETERS (mm) |
|---|---|---|
| 10 | 2.5 | A |
| 20 | 5.0 | B |
| 30 | 7.5 | C |
| 40 | 10.0 | D |
| 50 | 12.5 | E |

where the orifice diameters are selected from

| | | | | | |
|---|---|---|---|---|---|
| A | .125 | .25 | .5 | .75 | 1.0 |
| B | .25 | .5 | .75 | 1.0 | 2.0 |
| C | .5 | .75 | 1.0 | 2.0 | 3.0 |
| D | .75 | 1.0 | 2.0 | 3.0 | 4.0 |
| E | 1.0 | 2.0 | 3.0 | 4.0 | 5.0 |

Figure 9:
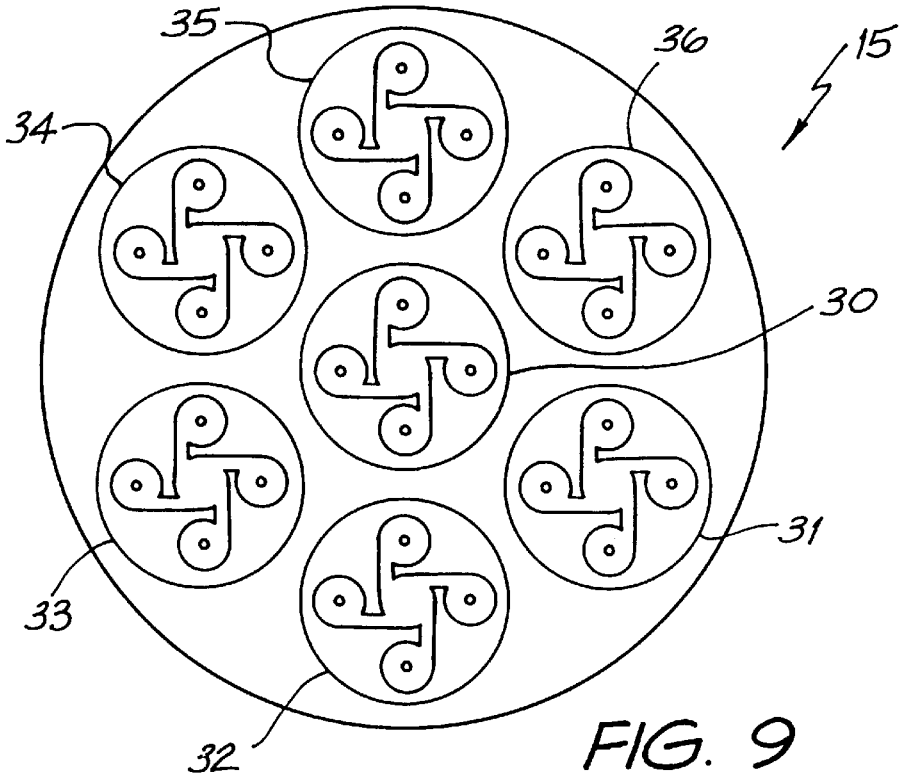
FIG. 9 is a plan view of a nozzle member according to the fourth embodiment of the invention.
Figure 10:
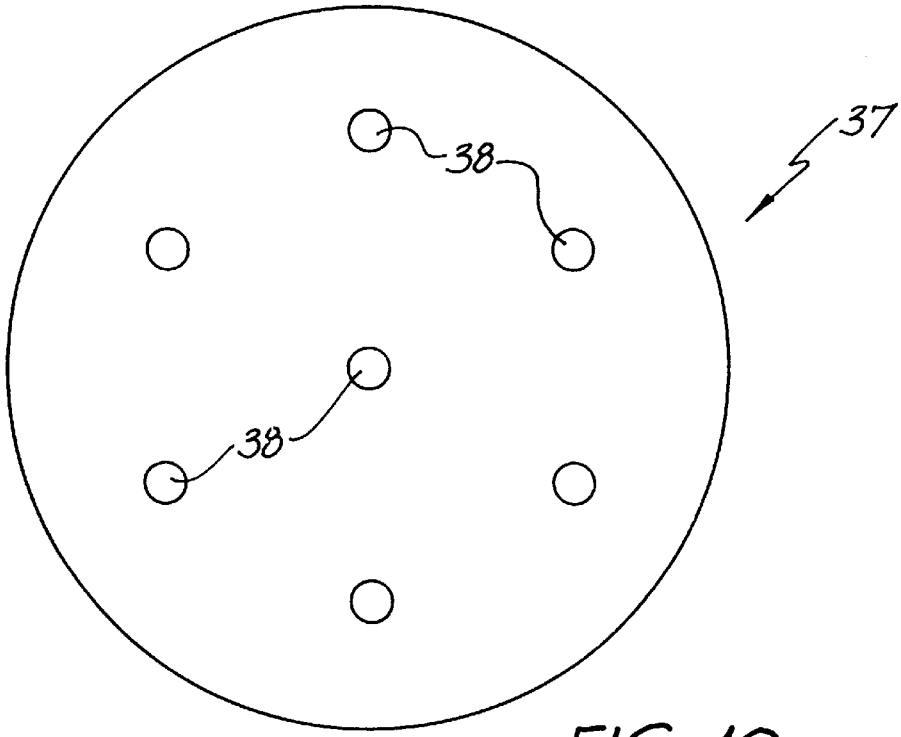
FIG. 10 is a plan view of a core member for use with the nozzle member of FIG. 9.

The embodiment of the nozzle member 15 shown in FIG. 9 includes a central nozzle 30 and an array of nozzles 31 to 36 around the central nozzle 30. The nozzles 30 to 36 may be the same as each other or may be different. Although shown as being similar to the nozzle of FIG. 6, the nozzles 30 to 36 may be of any convenient configuration, size, number and spacing. The core member 37 has apertures 38 of any convenient size and configuration which align with the respective chambers of the nozzles 30 to 36.

Various modifications may be made in details of design and construction without departing from the scope and ambit of the invention. For example, the outer chambers may be of any convenient shape such as oval, elliptical or rectangular as well as circular as shown in the drawings.

What is claimed is:

1. A nozzle assembly for a spray head of the type having a tubular body or housing that has an inlet thereto and an outlet therefrom, the improvement comprising:

a nozzle member and a core member, said nozzle member having a central chamber adapted to be in fluid communication with the inlet of the spray head, and a plurality of outer chambers in communication with the central chamber and adapted to be in fluid communication with the outlet of the spray head, said nozzle member and said core member having a threadless adjustment for spacing the core member with respect to the nozzle member, the threadless adjustment comprising a seating of a peripheral rim of the core member with a rim of the nozzle member.

2. The nozzle assembly according to claim 1, wherein the core member is removable and replaceable so that the height of the central chamber may be varied by using different core members, the core member and nozzle member forming a fixed, threadless gap once assembled.

3. The nozzle assembly according to claim 1, wherein each outer chamber is defined by an inner wall and an outer wall and has an outer face having an orifice.

4. The nozzle assembly according to claim 3, wherein a bottom face of each outer chamber has a squared edge.

5. The nozzle assembly according to claim 3, wherein a bottom face of each outer chamber has a rounded edge.

6. The nozzle assembly according to claim 3, wherein a bottom face of each outer chamber has a curved edge.

7. The nozzle assembly according to claim 1, wherein said plurality of outer chambers comprises four outer chambers.

8. The nozzle assembly according to claim 1, wherein said plurality of outer chambers comprises six outer chambers.

9. A spray head incorporating a nozzle assembly according to claim 1.

10. A spray head incorporating a plurality of nozzle assemblies according to claim 1.

11. The nozzle assembly of claim 1, further comprising:

a washer which seats in an annular recess of the core member, the recess formed in a face of the core member opposite the rim which contacts the nozzle member.

* * * * *